US007560979B1

(12) United States Patent
Hsu et al.

(10) Patent No.: US 7,560,979 B1
(45) Date of Patent: Jul. 14, 2009

(54) REFERENCE VOLTAGE DEVICES AND METHODS THEREOF

(75) Inventors: Yen-Hsun Hsu, Hsinchu Hsien (TW); Hao-Ping Hong, Chiayi (TW)

(73) Assignee: Mediatek Inc., Hsin-Chu (TW)

( * ) Notice: Subject to any disclaimer, the term of this patent is extended or adjusted under 35 U.S.C. 154(b) by 9 days.

(21) Appl. No.: 12/032,717

(22) Filed: Feb. 18, 2008

(51) Int. Cl.
*G05F 1/10* (2006.01)

(52) U.S. Cl. ..... 327/539

(58) Field of Classification Search ..... 327/535, 327/537, 539
See application file for complete search history.

(56) References Cited

U.S. PATENT DOCUMENTS 6,462,612 B1 * 10/2002 Roh et al. ..... 327/539
6,724,176 B1 * 4/2004 Wong et al. ..... 323/316
7,071,767 B2 * 7/2006 Ou-yang et al. ..... 327/539
7,119,528 B1 * 10/2006 Rasmus ..... 323/317

* cited by examiner

*Primary Examiner*—Jeffrey S Zweizig
(74) *Attorney, Agent, or Firm*—Thomas, Kayden, Horstemeyer & Risley

(57) ABSTRACT

A reference voltage device and a reference voltage generating method thereof. The reference voltage device comprises a bandgap unit, a voltage generating unit, a comparator, and a calibration controller. The calibration controller controls the voltage generating unit to generate a final calibrating voltage to serve as an ideal target voltage. The bandgap unit generates a bandgap voltage with zero offset voltage according to the final calibrating voltage to serve as a reference voltage. The variation of the reference voltage output by the reference voltage device is thus reduced.

22 Claims, 10 Drawing Sheets

REFERENCE VOLTAGE DEVICES AND METHODS THEREOF

BACKGROUND OF THE INVENTION

1. Field of the Invention

The present invention relates to a reference voltage generating method, and in particular relates to a reference voltage device.

2. Description of the Related Art

Integrated circuits often require a reference voltage which remains stable under PVT (process, voltage, temperature) variations. FIG. 1 depicts a conventional generating circuit of a bandgap voltage serving as a reference voltage for integrated circuits. Referring to FIG. 1, the generating circuit 1 comprises an operational amplifier OPAMP, bipolar devices B11 and B12, and resistors R11 to R13. The values of the resistors R11 and R12 are the same. The operational amplifier OPAMP of a high gain is used, and base-emitter voltage Vbe1 and Vbe1' are almost equal due the closed loop. A bandgap voltage Vbg is determined according to the base-emitter voltage Vbe1 and Vbe2 (negative temperature coefficient) and thermal voltage $V_T$ (positive temperature coefficient) of the bipolar devices B11 and B12. With a proper ratio of the base-emitter voltage and the thermal voltage $V_T$ for each bipolar, the temperature dependence of the bandgap voltage Vbg is almost eliminated.

However, because the area of the bipolar devices B11 and B12 is different, the current density in the bipolar devices B11 and B12 is also different, thus, the base-emitter voltage Vbe1 and Vbe2 of the bipolar devices B11 and B12 becomes unequal. Accordingly, the same current density in different areas of the bipolar devices B11 and B12 results in a current magnitude which is equal to ΔVbe/R13 and provides a positive temperature coefficient. The bandgap voltage Vbg is then determined according to the base-emitter voltage Vbe1 and a scale of ΔVbe and expressed as:

$$Vbg = Vbe1 + \frac{R12}{R13} \times \Delta Vbe$$

Typically, the ratio of the resistors R12 and R11 is equal to about 10 to nullify the temperature coefficient.

FIG. 2 depicts another conventional generating circuit of a bandgap voltage operating at low voltage, serving as a reference voltage for integrated circuits. Referring to FIG. 2, the generating circuit 2 mainly comprises an operational amplifier OPAMP, bipolar devices B21 and B22, and resistors R21 to R24. The values of the resistor R21 and R22 are the same. A bandgap voltage can be scaled freely by adjusting the ratio of the resistors and expressed as:

$$Vbg = \frac{R24}{R22} = \times\left(Vbe1 + \frac{R22}{R23} \times \Delta Vbe\right)$$

According to the two generating circuits 1 and 2, the bandgap voltage of the generating circuit 2 is equal to R24/R22 of that of the generating circuit 1.

In above generating circuits 1 and 2, it is assumed that the operational amplifier OPAMP is ideal, meaning that the voltage of the two input terminals of the operational amplifier OPAMP is ideally equal. In practice, however, the voltage of two input terminals of the operational amplifier OPAMP is not equal, and there is a non-zero offset voltage Vos between the two input terminals. When the non-zero offset voltage Vos is considered, the generating circuit 1 of FIG. 1 is redrawn as in FIG. 3, and a bandgap voltage Vbg' is expressed as:

$$Vbg' = Vbe1 + \frac{R12}{R13} \times \Delta Vbe + \left(1 + \frac{R12}{R13}\right) \times Vos \qquad \text{(Equation 1)}$$

Similarly, when the non-zero offset voltage Vos is considered, a bandgap voltage Vbg' generated by the generating circuit 2 of FIG. 2 is expressed as:

$$Vbg' = \frac{R24}{R22} \times \left[\left(Vbe1 + \frac{R22}{R23} \times \Delta Vbe + \left(1 + \frac{R22}{R23}\right) \times Vos\right]\right. \qquad \text{(Equation 2)}$$

According to Equation 1 and Equation 2, the non-zero offset voltage Vos of the operational amplifier OPAMP is amplified by (1+R22/R23). As described previously, in order to nullify temperature dependence of the bandgap voltage, the ratio of the resistors R2 and R1 is set to about 10. Thus, when the non-zero offset voltage Vos is considered, the bandgap voltage Vbg may drift from its ideal value by 10 times the non-zero offset voltage Vos. The amplified non-zero offset voltage Vos causes the reference voltage to vary greatly from chip to chip.

In order to reduce the variation of the reference voltage from chip to chip, several techniques are introduced. One method uses a trimming circuit. FIG. 4 depicts a trimming circuit. A bandgap voltage Vbg' with a non-zero offset voltage Vos is amplified by an amplifier 40, and a trimmed output voltage Vref is selected from a resistor string 41. At the beginning of the trimming process, an ideal target voltage value is applied to an external tester and compared with an output voltage Vref of the trimming circuit. The output voltage Vref is selected by varying a final control code CODE40 which is determined according to the comparison result signal. When the output voltage Vref is equal to the ideal target voltage value, the final control code CODE40 is obtained. According to the final control code CODE40, the trimmed output voltage Vref is determined. The ideal target voltage value and the trimmed output voltage Vref can be fixed and remembered in an IC by fuses which can be programmed by laser or electronically. The trimming process, however, requires more time in the tester for calibration and fuses trimming.

Chopper stabilization is another method to reduce the variation in the reference voltage. U.S. Pat. No. 6,462,612 discloses a chopper stabilized bandgap reference circuit to cancel offset variation. Referring to FIG. 5, an input signal of an amplifier 51 is modulated by a high frequency modulator (MOD) 50. The modulated signal is amplified by the amplifier 51 and demodulated by a demodulator (DEMOD) 52. Since an offset voltage of the amplifier 51 is not modulated, the offset voltage is modulated to a high frequency in the demodulation process. The high frequency noise can be filtered by a low pass filter (LPF) 53. The chopper stabilized bandgap reference circuit is useful to reduce the variation caused by the offset voltage of the amplifier 51. The circuit requires a high frequency clock for modulation, however, which produces noise. Moreover, the low pass filter 53 occupies a large area.

BRIEF SUMMARY OF THE INVENTION

An exemplary embodiment of a method for calibrating a bandgap voltage generated by a bandgap unit is provided. The bandgap unit comprises an operational amplifier. The method comprises switching a first input with a second input of the operational amplifier to measure a first bandgap voltage and a second bandgap voltage respectively, averaging the first bandgap voltage and the second bandgap voltage to generate a calibration voltage, and modifying the bandgap voltage so that a resulting bandgap voltage is equal to the calibration voltage.

An exemplary embodiment of a calibration circuit for calibrating an input offset of an operational amplifier is provided. The operational amplifier is used in a bandgap unit. The calibration circuit comprises a comparator, a calibration controller, and a voltage DAC. The comparator receives a bandgap voltage and a calibration voltage. The bandgap voltage is generated by the bandgap unit and the comparator generates a comparison result signal. The calibration controller receives the comparison result signal to generate a digital code and generates a control code to adjust the bandgap voltage. The voltage DAC receives the digital code to generate the calibration voltage.

An exemplary embodiment of a reference voltage generating method for a reference voltage device is provided. The reference voltage comprises a bandgap unit which alternately operates in two modes. The reference voltage generating method comprises, for each mode of the bandgap unit, setting an operation mode of the bandgap unit to one of the two modes, generating a calibration voltage based a first control code, comparing the calibration voltage with a bandgap voltage output by the bandgap unit to generate a first comparison result signal to indicate whether or not the calibration voltage is greater than the bandgap voltage, adjusting the first control code to modify the calibration voltage based on the first comparison result signal, and recoding the first control code when the calibration voltage is substantially equal to the bandgap voltage. The reference voltage generating method further comprises generating a second control code by averaging the first control codes, generating the calibration voltage to form a final calibration voltage based on the second control code, and generating the bandgap voltage of the bandgap unit based on the final calibration voltage to serve as the reference voltage.

An exemplary embodiment of a reference voltage device is provided. The reference voltage device comprises a bandgap unit, a voltage generating unit, a comparator, and a calibration controller. The bandgap unit alternately operates in two modes according to a selected signal and generates a bandgap voltage. The voltage generating unit receives a first control code and generates a calibrating voltage according to the first control code in each mode of the bandgap unit. The comparator receives and compares the bandgap voltage and the calibrating voltage, and generates a first comparison result signal according to the comparison result in each mode of the bandgap unit. The first comparison result signal indicates whether or not the calibrating voltage is greater than the bandgap voltage. The calibration controller receives the first comparison result signal, adjusts the first control code to modify the calibrating voltage based on the first comparison result signal, and recodes the first control code when the calibrating voltage is substantially equal to the bandgap voltage in each mode of the bandgap unit.

The calibration controller generates a second control code by averaging the recoded first control codes in the first and second modes. The voltage generating unit generates the calibration voltage to form a final calibrating voltage based on the second control code. The bandgap unit generates the bandgap voltage based on the final calibrating voltage to serve as the reference voltage.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
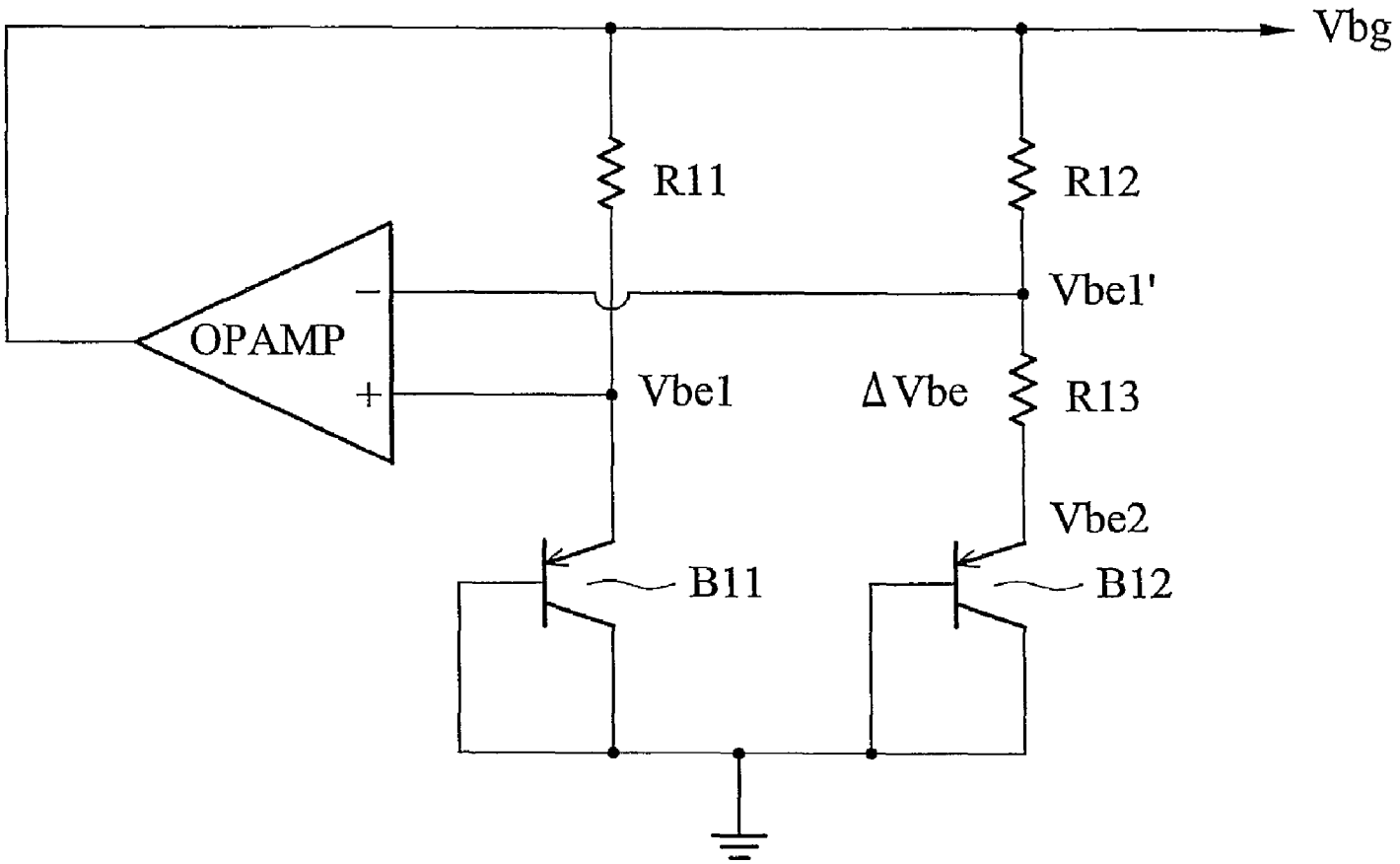
FIG. 1 ( RELATED ART )
FIG. 1 depicts a conventional generating circuit of a bandgap voltage.
Figure 2:
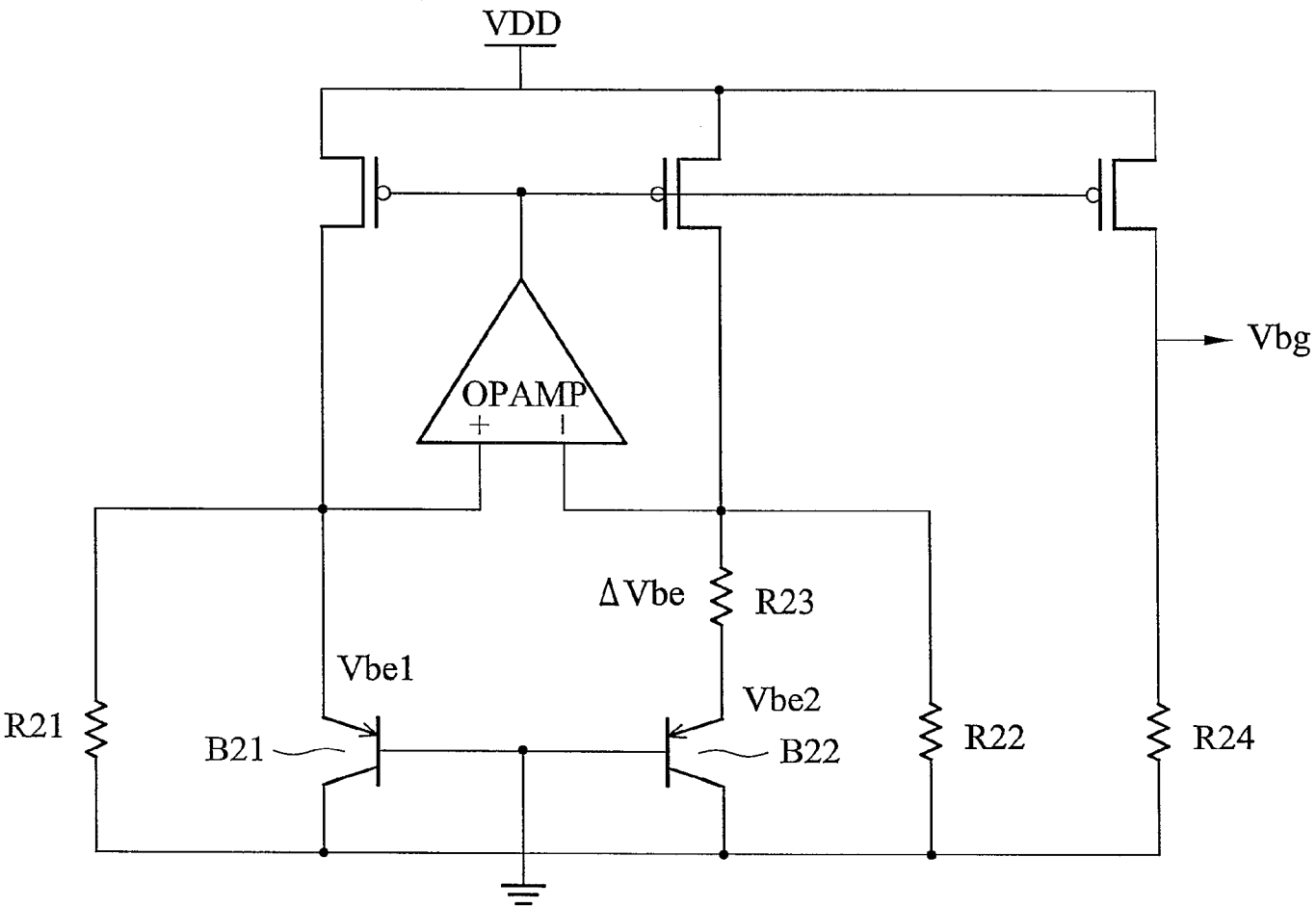
FIG. 2 ( RELATED ART )
FIG. 2 depicts another conventional generating circuit of a bandgap voltage operating t low voltage.
Figure 3:
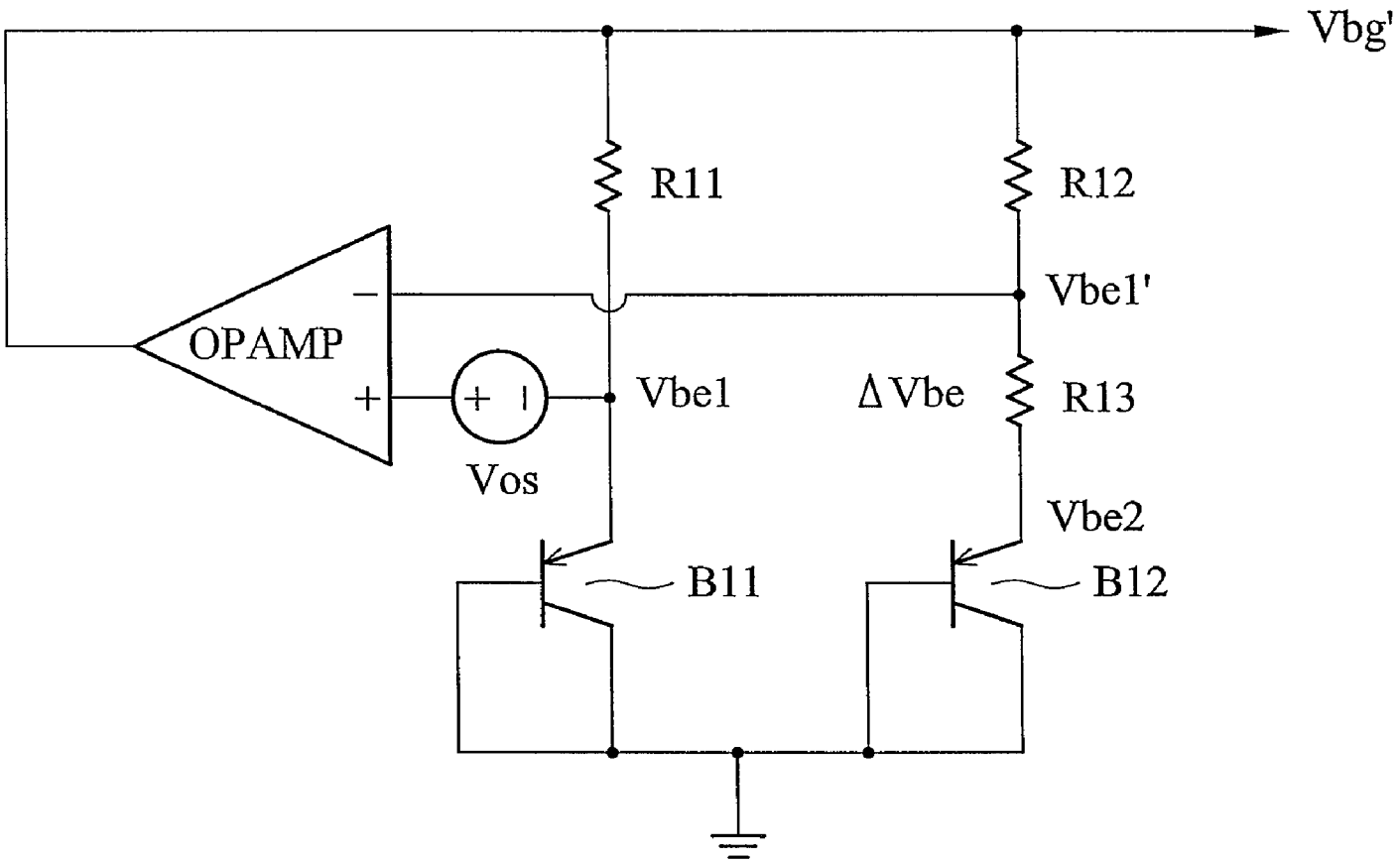
FIG. 3 ( RELATED ART )
FIG. 3 shows a non-zero offset voltage Vos of a conventional generating circuit of a bandgap voltage in FIG. 1.
Figure 4:
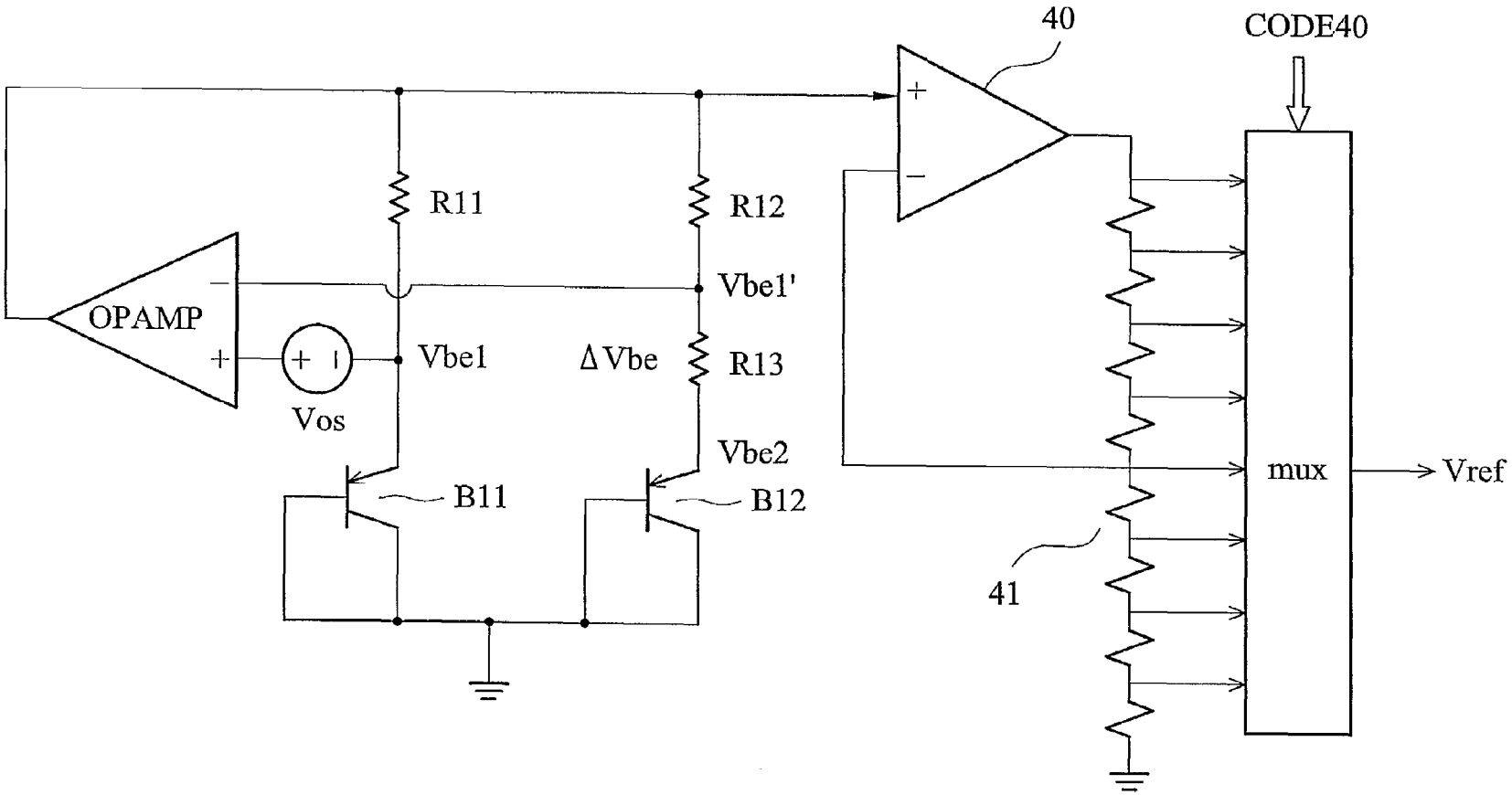
FIG. 4 ( RELATED ART )
FIG. 4 depicts a trimming circuit.
Figure 5:
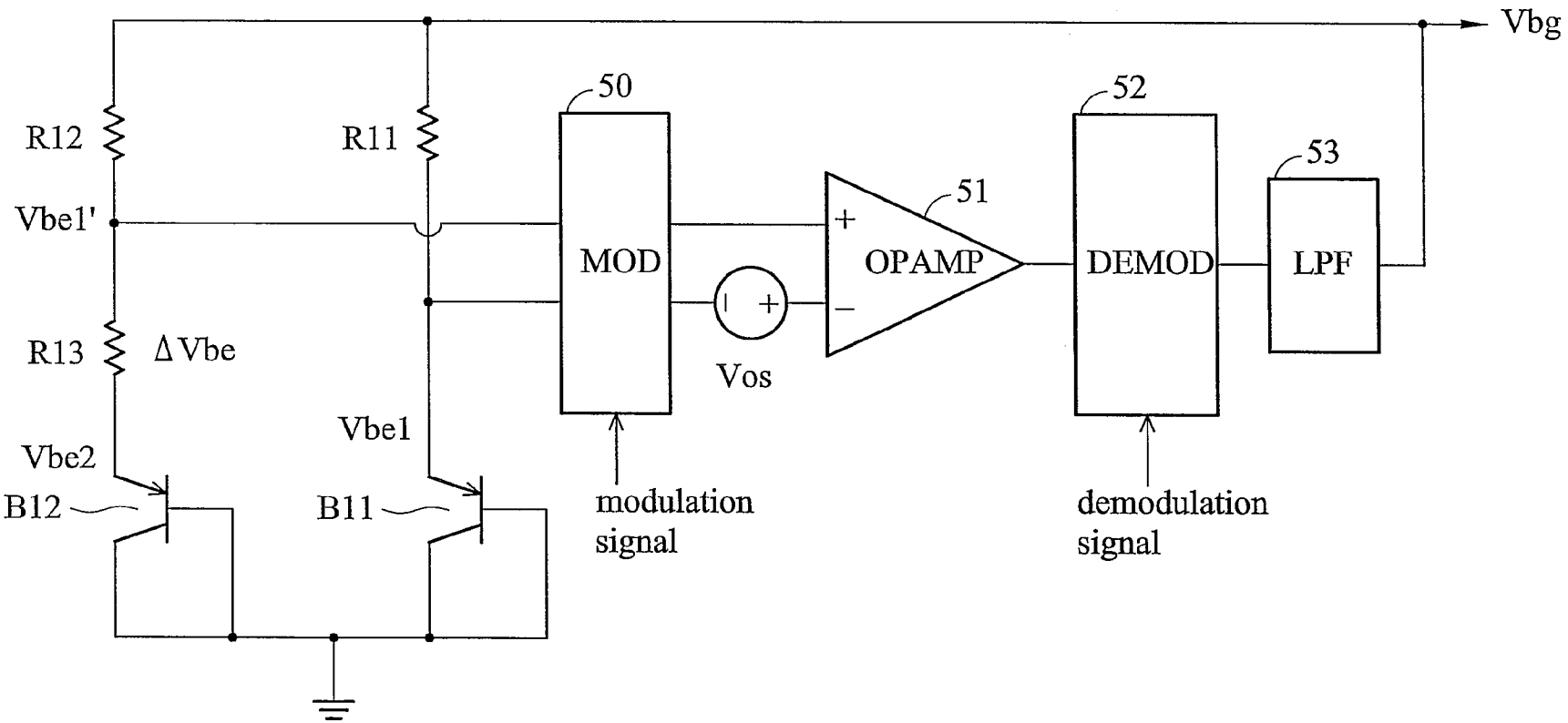
FIG. 5 ( RELATED ART )
FIG. 5 shows a chopper stabilized bandgap reference circuit to cancel offset variation.
Figure 6:
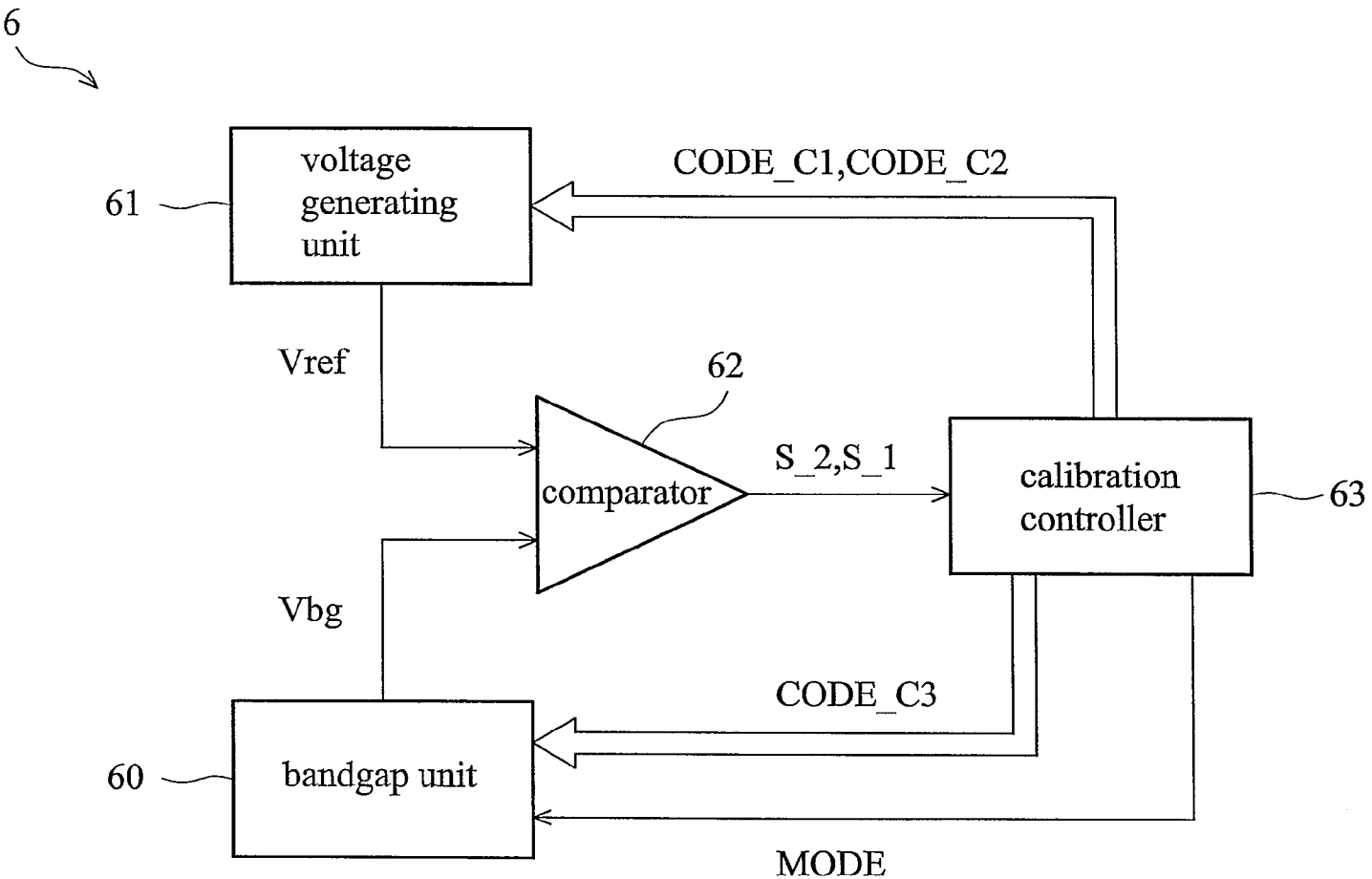
FIG. 6 depicts an embodiment of a reference voltage device.

Reference voltage devices are provided. In the exemplary embodiment of a reference voltage device of FIG. 6, a reference voltage device 6 generates a reference voltage and comprises a bandgap unit 60, a voltage generating unit 61, a comparator 62, and a calibration controller 63. The bandgap unit 60 alternately operates in first and second modes and outputs a bandgap voltage Vbg. In this embodiment, the bandgap unit 60 is implemented by the generating circuit 1 in FIG. 1, without limitation.

First, the operation mode of the bandgap unit 60 is set to the first mode according to a selecting code MODE provided by the calibration controller 63. The calibration controller 63 provides a first control code CODE_C1 to the voltage generating unit 61. The voltage generating unit 61 generates a calibration voltage Vref based the first control code CODE_C1. The bandgap voltage Vbg has a positive offset voltage in the first mode and serves as a bandgap voltage Vbg_high, and the bandgap voltage Vbg_high is expressed as:

$$\text{Vbg_high} = Vbe1 + \frac{R12}{R13} \times \Delta Vbe + \left(1 + \frac{R12}{R13}\right) \times Vos$$

The comparator 62 compares the calibration voltage Vref with the bandgap voltage Vbg_high to generate a first comparison result signal S_1 to indicate the calibration voltage Vref is greater than the bandgap voltage Vbg_high or not. The calibration controller 63 adjusts the first control code CODE_C1 to modify the calibration voltage Vref based on the first comparison result signal S_1. When the calibration voltage Vref is substantially equal to the bandgap voltage Vbg_high, the calibration controller 63 recodes the first control code CODE_C1 to be a code CODE_HIGH.

Then, the operation mode of the bandgap unit is set to the second mode according to the selecting code MODE. The voltage generating unit 61 generates the calibration voltage Vref based the first control code CODE_C1. The bandgap voltage Vbg has a negative offset voltage in the second mode and serves as a bandgap voltage Vbg_low, and the bandgap voltage Vbg_low is expressed as:

$$\text{Vbg_low} = Vbe1 + \frac{R12}{R13} \times \Delta Vbe - \left(1 + \frac{R12}{R13}\right) \times Vos$$

The comparator 62 compares the calibration voltage Vref with the bandgap voltage Vbg_low to generate the first comparison result signal S_1 to indicate the calibration voltage Vref is greater than the bandgap voltage Vbg_low or not. The calibration controller 63 adjusts the first control code CODE_C1 to modify the calibration voltage Vref based on the first comparison result signal S_1. When the calibration voltage Vref is substantially equal to the bandgap voltage Vbg_low, the calibration controller 63 recodes the first control code CODE_C1 to be a code CODE_LOW.

After the first and second modes, the calibration controller 63 generates a second control code CODE_C2 by averaging the codes CODE_HIGH and CODE_LOW.

The voltage generating unit 61 generates the calibration voltage Vref to yield a final calibration voltage Vref_F based on the second control code CODE_C2. The final calibration voltage Vref_F is expressed as:

$$\text{Vref_F} = \frac{1}{2}(\text{Vbg_high} + \text{Vbg_low}) = Vbe + \frac{R12}{R13} \times \Delta Vbe$$

According to the above equation, the variation due to OPAMP offset voltage of the bandgap unit 60 is removed. The comparator 62 compares the bandgap voltage Vbg with the final calibration voltage Vref_F to generate a second comparison result signal S_2 to indicate the bandgap voltage Vbg is greater than the final calibration voltage Vref_F or not. The calibration controller 63 adjusts a third control code CODE_C3 to modify the bandgap voltage Vbg based on the second comparison result signal S_2. When the bandgap voltage Vbg is substantially equal to the final calibration voltage Vref_F, the bandgap unit 60 outputs the bandgap voltage Vbg to serve as the reference voltage. After a final version of the third control code CODE_C3 is sent to adjust the bandgap voltage Vbg, the voltage generating unit 61, the comparator 62, and the calibration controller 63 can be powered down to save power. The voltage generating unit 61 can also be powered down after the third control code CODE_C3 is sent to adjust the bandgap voltage Vbg.

Figure 7:
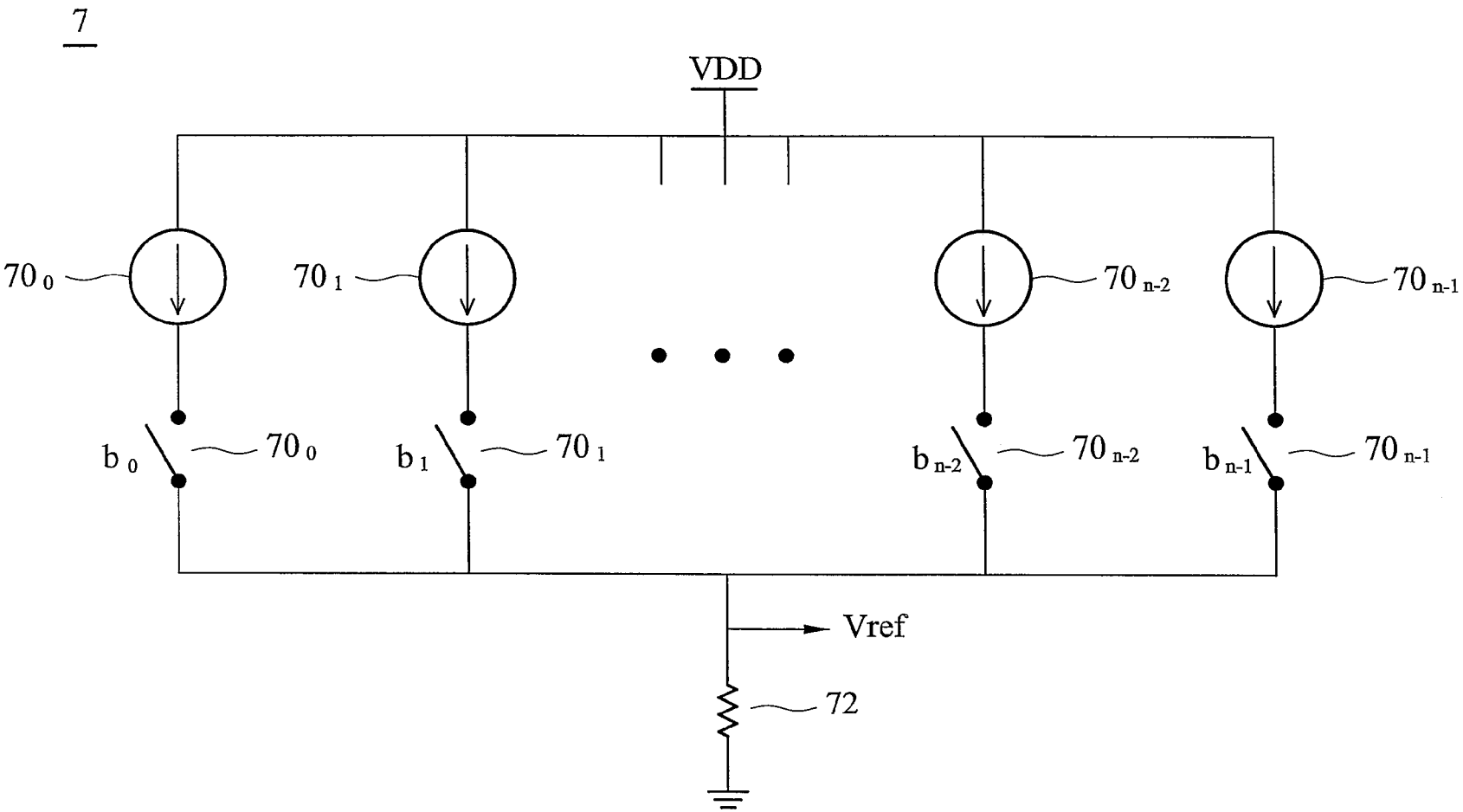
FIG. 7 depicts an embodiment of a voltage generating unit in FIG. 6.

In this embodiment, the first control code CODE_C1 and the second control code CODE_C2 can be digital signals, and the voltage generating unit 61 can be a voltage digital/analog converter (DAC), as shown in FIG. 7. A voltage DAC 7 receives first control code CODE_C1 of n bits and outputs the calibration voltage Vref in the first and second modes, or receives the second control code CODE_C2 of n bits and outputs the final calibration voltage Vref_F. The voltage DAC 7 comprises n current sources $\mathbf{70}_0$ to $\mathbf{70}_{n-1}$, n switches $\mathbf{71}_0$ to $\mathbf{71}_{n-1}$, and a resistor 72.

Figure 8:
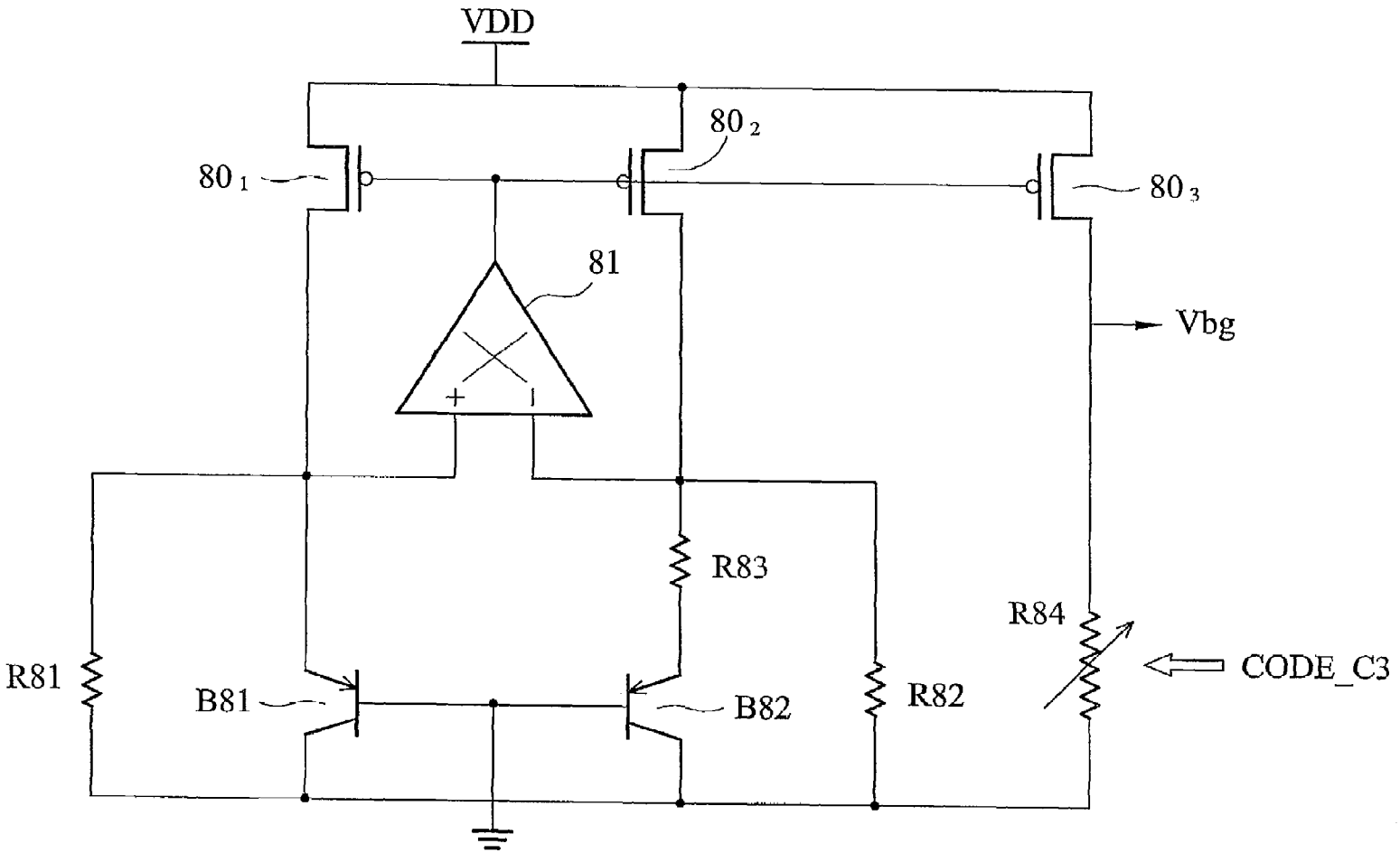
FIG. 8 depicts an embodiment of a bandgap unit in FIG. 6.
Figure 9:
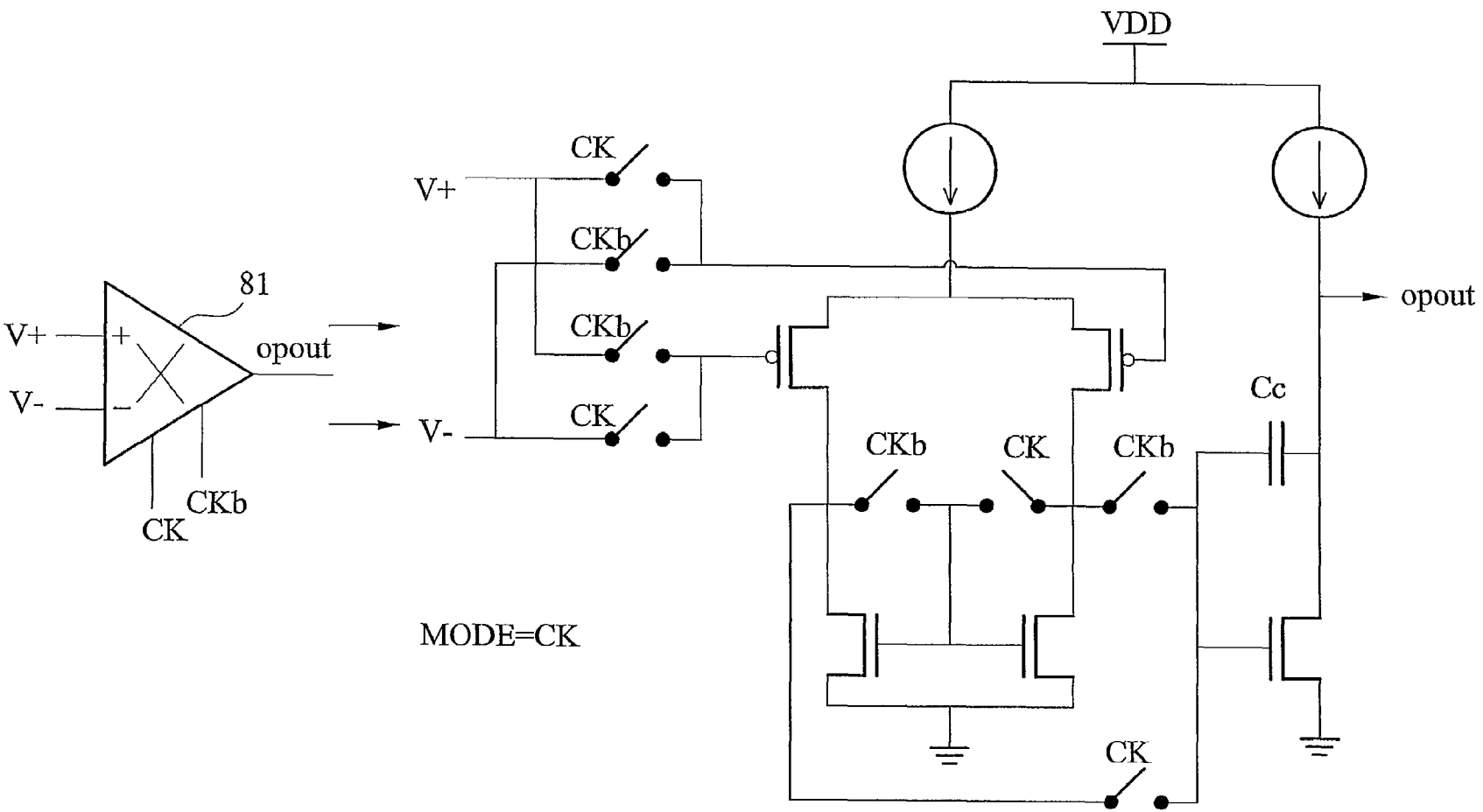
FIG. 9 shows a circuit of an operational amplifier in FIG. 8.

FIG. 8 depicts an embodiment of the bandgap unit 60. The bandgap unit 60 comprises transistors 801 to 803, resistors R81 to R83, bipolar transistors B81 and B82, an operational amplifier 81, and a variable resistor R84. The values of the resistors R81 and R82 are the same. The variable resistor R84 is controlled by the third control code CODE_C3. FIG. 9 shows a circuit of the operational amplifier 81 of the bandgap unit 60 in FIG. 8. The operational amplifier 83 is controlled by a clock CK and an inverse clock CKb, wherein the selecting code MODE serves as the clock CK, and an inverse code of the selecting code MODE serves as the inverse clock CKb.

Figure 10:
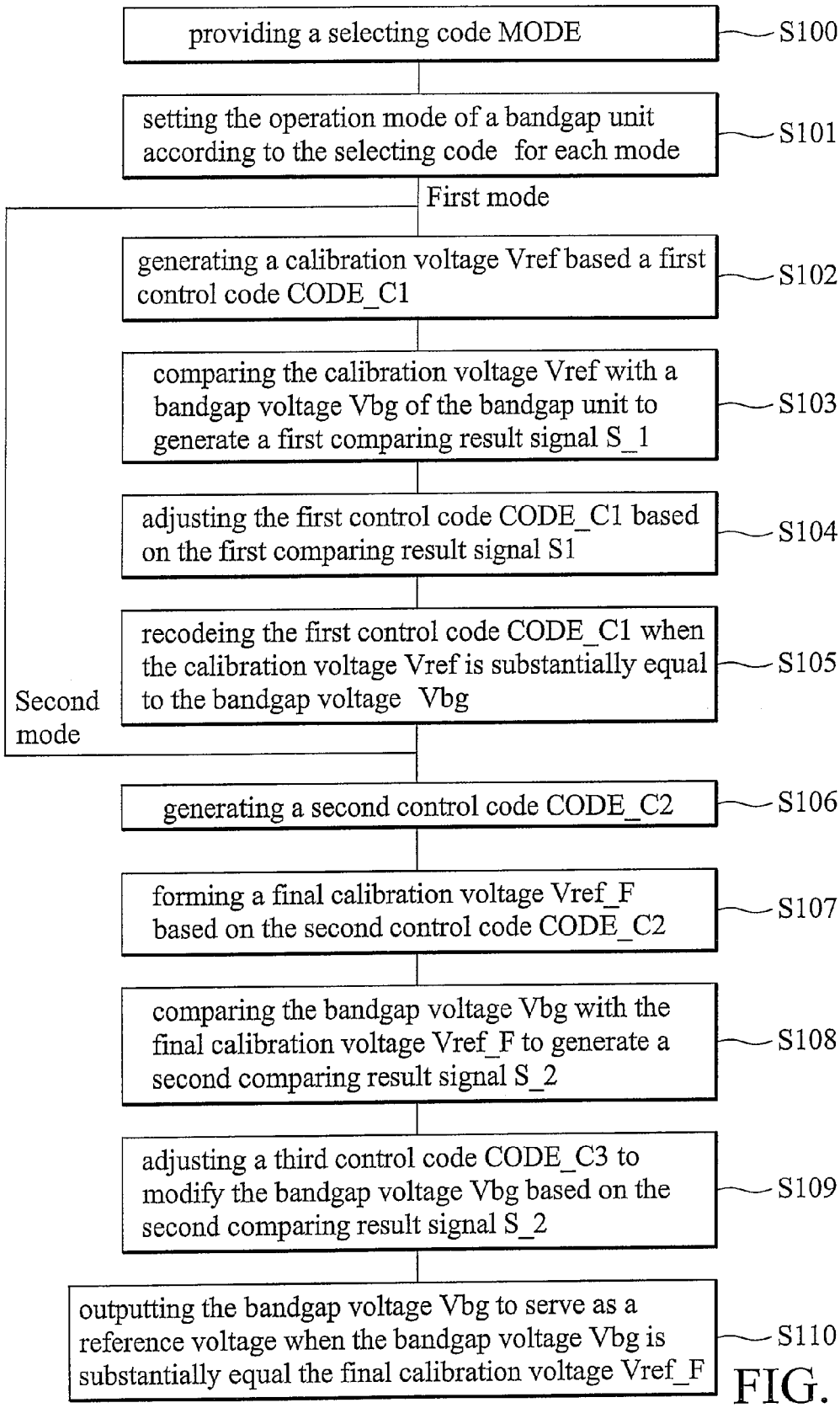
FIG. 10 is a flow chart of an embodiment of a reference voltage generating method.

FIG. 10 is a flowchart of an embodiment of a reference voltage generating method for a reference voltage device. The reference voltage device comprises a bandgap unit which alternately operates in two modes. A calibration controller provides a selecting code MODE (step S100) to indicate the operation mode of the bandgap unit is the first or second mode. The operation mode of the bandgap unit is set according to the selecting code MODE (step 101). First, the operation mode of the bandgap unit is set to the first mode. The calibration controller provides a first control code CODE_C1 to a voltage generating unit. The voltage generating unit generates a calibration voltage Vref (step S102) based the first control code CODE_C1. The bandgap unit outputs a bandgap voltage Vbg. In the first mode, the bandgap voltage Vbg has a positive offset voltage and serves as a bandgap voltage Vbg_high.

A comparator compares the calibration voltage Vref with the bandgap voltage Vbg_high to generate a first comparison result signal S_1 (step S103), and the first comparison result signal S_1 indicates whether or not the calibration voltage Vref is greater than the bandgap voltage Vbg_high. The calibration controller adjusts the first control code CODE_C1 to modify the calibration voltage Vref based on the first comparison result signal S_1 (step S104). When the calibration voltage Vref is substantially equal to the bandgap voltage Vbg_high, the calibration controller recodes the first control code CODE_C1 to be a code CODE_HIGH (step S105).

The operation mode of the bandgap unit is then set to the second mode, and the steps S102 to S104 are repeated. The calibration controller provides the first control code CODE_C1 to the voltage generating unit. The voltage generating unit generates the calibration voltage Vref (step S102) based the first control code CODE_C1. In the second mode, the bandgap voltage Vbg has a negative offset voltage and serves as a bandgap voltage Vbg_low. The comparator compares the calibration voltage Vref with the bandgap voltage Vbg_low to generate the first comparison result signal S_1 (step S103), and the first comparison result signal S_1 indicates whether or not the calibration voltage Vref is greater than the bandgap voltage Vbg_low. The calibration controller adjusts the first control code CODE_C1 to modify the calibration voltage Vref based on the first comparison result signal S_1 (step S104). When the calibration voltage Vref is substantially equal to the bandgap voltage Vbg_low, the calibration controller recodes the first control code CODE_C1 to be a code CODE_LOW (step S105).

After the first and second modes, the calibration controller generates a second control code CODE_C2 by averaging the codes CODE_HIGH and CODE_LOW (step S106). The voltage generating unit generates the calibration voltage Vref to yield a final calibration voltage Vref_F based on the second control code CODE_C2 (step S107). The comparator compares the bandgap voltage Vbg with the final calibration voltage Verf_F to generate a second comparison result signal S_2 (step S108). The second comparison result signal S_2 indicates whether or not the bandgap voltage Vbg is greater than the final calibration voltage Vref_F. The calibration controller adjusts a third control code CODE_C3 to modify the bandgap voltage based Vbg on the second comparison result signal S_2 (step 109). When the bandgap voltage Vbg is substantially equal to the final calibration voltage Vref_F. the bandgap unit outputs the bandgap voltage Vbg to serve as the reference voltage (step S110).

According to the invention, a reference voltage is generated without a non-zero offset voltage. The invention does not require an area consuming low pass filter. The low pass filter is replaced by digital averaging. Moreover, no high frequency modulation is performed, thus, noise is reduced.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for calibrating a bandgap voltage generated by a bandgap unit, the bandgap unit comprising an operational amplifier, the method comprising:

switching a first input with a second input of the operational amplifier to measure a first bandgap voltage and a second bandgap voltage respectively;

averaging the first bandgap voltage and the second bandgap voltage to generate a calibration voltage; and modifying the bandgap voltage so that a resulting bandgap voltage is equal to the calibration voltage.

2. The method as claimed in claim 1, wherein the measuring is performed by monitoring states changing of a comparator.

3. The method as claimed in claim 1, wherein the calibration voltage is generated by a voltage DAC.

4. The method as claimed in claim 3, wherein the first bandgap voltage and the second bandgap voltage are represented by a first digital code and a second digital code received by the voltage DAC, and the averaging step is performed by averaging the first digital code and the second digital code to generate a third digital code, the third digital code being corresponding to the calibration voltage.

5. A calibration circuit for calibrating an input offset of an operational amplifier, the operational amplifier being used in a bandgap unit, the calibration circuit comprising:

a comparator receiving a bandgap voltage and a calibration voltage, the bandgap voltage being generated by the bandgap unit, the comparator generating a comparison result signal;

a calibration controller receiving the comparison result signal to generate a digital code, the calibration controller generating a control code to adjust the bandgap voltage; and a voltage DAC receiving the digital code to generate the calibration voltage.

6. The calibration circuit as claimed in claim 5, wherein the calibration controller generates a selecting code to the bandgap unit so that the bandgap unit switches between a first mode and a second mode.

7. The calibration circuit as claimed in claim 6, wherein in each of the first and second modes, the calibration controller adjusts the digital code until the comparison result signal changes states.

8. The calibration circuit as claimed in claim 6, wherein the calibration controller adjusts the control code until the comparison result signal changes states.

9. The calibration circuit as claimed in claim 5, wherein the calibration circuit is powered down after a final version of the control code is sent to the bandgap unit.

10. The calibration circuit as claimed in claim 5, wherein the voltage DAC is powered down after a final version of the control code is sent to the bandgap unit.

11. A reference voltage generating method for a reference voltage device comprising a bandgap unit which alternately operates in two modes, the reference voltage generating method comprising:

for each mode of the bandgap unit performing:

setting an operation mode of the bandgap unit to one of the two modes;

generating a calibration voltage based a first control code;

comparing the calibration voltage with a bandgap voltage output by the bandgap unit to generate a first comparison result signal to indicate whether or not the calibration voltage is greater than the bandgap voltage;

adjusting the first control code to modify the calibration voltage based on the first comparison result signal; and recoding the first control code when the calibration voltage is substantially equal to the bandgap voltage;

generating a second control code by averaging the first control codes;

generating the calibration voltage to form a final calibration voltage based on the second control code; and generating the bandgap voltage of the bandgap unit based on the final calibration voltage to serve as the reference voltage.

12. The reference voltage generating method as claimed in claim 11, wherein the step of generating the bandgap voltage of the bandgap unit comprises:

comparing the bandgap voltage with the final calibration voltage to generate a second comparison result signal to indicate the bandgap voltage is greater than the final calibration voltage or not;

adjusting a third control code to modify the bandgap voltage based on the second comparison result signal; and outputting the bandgap voltage to serve as the reference voltage when the bandgap voltage is substantially equal the final calibration voltage.

13. The reference voltage generating method as claimed in claim 11, wherein the reference voltage serves as a supply voltage.

14. The reference voltage generating method as claimed in claim 11, wherein the reference voltage serves as a bandgap voltage reference.

15. The bandgap reference voltage generating method as claimed in claim 11, wherein the step of setting the operation mode of the bandgap unit comprises:

providing a selecting code to indicate whether the operation mode of the bandgap unit is the first or second mode; and setting the operation mode of the bandgap unit according to the selecting code.

16. The bandgap reference voltage generating method as claimed in claim 11, wherein the bandgap unit has a positive offset voltage in the first mode and a negative offset voltage in the second mode.

17. A reference voltage device comprising:

a bandgap unit alternately operating in two modes according to a selecting code and generating a bandgap voltage;

a voltage generating unit receiving a first control code and generating a calibrating voltage according to the first control code in each mode of the bandgap unit;

a comparator receiving and comparing the bandgap voltage and the calibrating voltage, and generating a first comparison result signal according to the comparison result in each mode of the bandgap unit, wherein the first comparison result signal indicates whether or not the calibrating voltage is greater than the bandgap voltage; and a calibration controller receiving the first comparison result signal, adjusting the first control code to modify the calibrating voltage based on the first comparison result signal, and recoding the first control code when the calibrating voltage is substantially equal to the bandgap voltage in each mode of the bandgap unit;

wherein the calibration controller generates a second control code by averaging the recoded first control codes, and voltage generating unit generates the calibration voltage to yield a final calibrating voltage based on the second control code; and wherein the bandgap unit generates the bandgap voltage based on the final calibrating voltage to serve as the reference voltage.

18. The reference voltage device as claimed in claim 17, wherein the comparator compares the bandgap voltage with the final calibration voltage to generate a second comparison result signal to indicate the bandgap voltage is greater than the final calibration voltage or not, the calibration controller adjusts a third control code to modify the bandgap voltage based on the second comparison result signal, and the bandgap unit outputs the bandgap voltage to serve as the reference voltage when the bandgap voltage is substantially equal the final calibration voltage.

19. The reference voltage device as claimed in claim 17, wherein the reference voltage serves as a supply voltage.

20. The reference voltage device as claimed in claim 17, wherein the reference voltage serves as a bandgap voltage reference.

21. The reference voltage device as claimed in claim 17, wherein the calibration controller further provides a selecting code to indicate that the operation mode of the of the bandgap unit is the first or second mode, and the operation mode of the bandgap unit is set according to the selecting code.

22. The reference voltage device as claimed in claim 17, wherein the bandgap unit has a positive offset voltage in the first mode and a negative offset voltage in the second mode.

* * * * *